US005779158A

United States Patent [19]

Baker

[11] Patent Number: 5,779,158

[45] Date of Patent: Jul. 14, 1998

[54] NOZZLE FOR USE WITH FIRE-FIGHTING FOAMS

[75] Inventor: Kenneth C. Baker, Pottstown, Pa.

[73] Assignee: National Foam, Inc., Lionville, Pa.

[21] Appl. No.: 633,241

[22] Filed: Apr. 16, 1996

[51] Int. Cl.[6] ..... B05B 7/06

[52] U.S. Cl. ..... 239/419.5; 239/422; 239/425.5; 239/427.5; 169/15

[58] Field of Search ..... 239/422, 425.5, 239/428, 428.5, 432, 440, 441, 458, 539, 423, 424, 427, 427.5, 419.3, 419.5; 169/14, 15

[56] References Cited

U.S. PATENT DOCUMENTS

| | | | |
|---|---|---|---|
| 2,513,417 | 7/1950 | Lindsay | 239/428 X |
| 3,644,076 | 2/1972 | Bagge | 239/434.5 X |
| 3,893,624 | 7/1975 | Thompson | 239/458 X |
| 4,061,248 | 12/1977 | Arena | 239/432 X |
| 4,213,936 | 7/1980 | Lodrick | 239/428 X |
| 4,497,442 | 2/1985 | Williams . | |
| 4,505,431 | 3/1985 | Huffman | 239/428 |
| 4,525,175 | 6/1985 | Stellaccio | 239/434.5 X |
| 4,640,461 | 2/1987 | Williams . | |
| 4,705,405 | 11/1987 | Williams . | |
| 4,781,467 | 11/1988 | Williams . | |
| 4,828,038 | 5/1989 | Williams . | |
| 5,012,979 | 5/1991 | Williams . | |
| 5,090,619 | 2/1992 | Barthold et al. | 239/428 X |
| 5,167,285 | 12/1992 | Williams et al. . | |
| 5,275,243 | 1/1994 | Williams et al. . | |
| 5,312,041 | 5/1994 | Williams et al. . | |

FOREIGN PATENT DOCUMENTS

| | | |
|---|---|---|
| 555644 | 10/1986 | Australia . |
| 0 099 626 | 2/1984 | European Pat. Off. . |
| 0099626 | 1/1987 | European Pat. Off. . |
| 0 399 646 | 11/1990 | European Pat. Off. . |
| 0 429 736 A1 | 6/1991 | European Pat. Off. . |
| 0 505 100 A1 | 9/1992 | European Pat. Off. . |
| 0 608 140 A2 | 7/1994 | European Pat. Off. . |

*Primary Examiner*—Andres Kashnikow
*Assistant Examiner*—Steven J. Ganey
*Attorney, Agent, or Firm*—Samuels, Gauthier, Stevens & Reppert

[57] ABSTRACT

A nozzle assembly including a nozzle body having an inlet at a first end and an outlet at a second end. A first fluid passageway is defined within the nozzle body for first fluids passing between the inlet and outlet. Second and third fluid passageways for respective second and third fluids are also defined within said nozzle body. A discharge mixing unit is provided at the second end and is in fluid communication with the first, second and third fluid passageways for mixing the first, second and third fluids to produce a discharge solution. The discharge mixing unit includes one or more mixing chambers provided on the interior surface of the second end of the nozzle body. The mixing chambers are defined between a plurality of inwardly extending blades from the interior surface of the second end. The second end of the nozzle body has an adjustably extending pattern selection sleeve. The third passageway includes a variable fluid flow control device which is operable for varying the expansion ratios of the discharge solution.

6 Claims, 7 Drawing Sheets

NOZZLE FOR USE WITH FIRE-FIGHTING FOAMS

BACKGROUND OF THE INVENTION

In the design and operation of air-foam nozzles of the type used for flammable liquid firefighting, there are a number of problems that must be solved. Over the years many nozzles have been developed attempting to overcome one, or more, of the following problems: (1) provide a simple means to inject firefighting foam concentrates into the water stream at the nozzle; (2) provide a means to insure thorough mixing of water and foam concentrate within the nozzle; (3) provide a means to control the amount of air entrained into the water-foam solution; and (4) provide a means of increasing the discharge range of aerated foam solution.

Conventional air-foam nozzles can easily be divided into two broad groups based on the "expansion ratio" of the nozzle. "Expansion ratio" is a term describing the final volume of air-foam bubbles when compared to the original volume of foam solution. As the expansion ratio of a foam sample increases, it indicates a greater ability of the nozzle to mechanically agitate and aerate the foam solution. A nozzle with a higher expansion ratio generates foam having a lighter weight per unit of volume, with smaller, more homogeneous, thinner-walled bubbles which are longer lasting due to their greater ability to retain foam liquid in the bubbles.

Air-foam nozzles designed for use with synthetic based foam concentrates know as aqueous film forming foams (AFFF) customarily have low expansion ratios, less than 4 to 1. AFFF foams are very effective on flammable liquid spill fires, and were originally developed for aircraft crash firefighting, where a rapidly spreading, low expansion foam blanket is preferred to give rapid knockdown of flames so that passengers and crew can be quickly rescued from a burning aircraft. This effectiveness is due in large part to an aqueous film that spreads on the surfaces of the flammable liquid as the foam bubbles break, thereby slowing vaporization from the surface of the liquid and helping prevent re-ignition. A low expansion, quick draining foam is preferred for this application.

Nozzles designed for use with AFFF concentrates may be subdivided into two additional types: (1) those in which foam solution is pumped to the nozzles through fire hose or piping as shown by the nozzle 10 of FIGS. 1A and 1B; and (2) those where foam solution is formed in the nozzle by water being pumped to the nozzle through fire hose or piping and foam concentrate being supplied to the nozzle through a separate conduit as shown by the nozzle 20 of FIGS. 2A and 2B.

In nozzles where foam solution is pumped to the nozzle as in the nozzle 10 of FIGS. 1A and 1B, water and concentrate have ample time for thorough mixing while traveling through the hose or piping. In nozzles where the water and foam concentrate must mix at the nozzle as in the nozzle 20 of FIGS. 2A and 2B, mixing may not be uniform, especially if the concentrate is injected on the inside of the cylinder formed by the water discharge.

This non uniform distribution of foam concentrate in the water stream will have a negative impact on the foam quality produced by the nozzle. The foam bubbles will not be uniform in size and as a result the expanded (aerated) foam will deteriorate rapidly. Foam with rapid deterioration (typically called fast draining) is not optimized and therefore is not likely to be suitable for the intended application.

Air can only be entrained on the outer surface of the discharge pattern when either type nozzle is adjusted at or near the straight stream setting as shown in FIGS. 1A and 2A when a pattern selection sleeve 12, 22 is adjusted to the outward position. This limited aeration results in low expansion ratios. Lower expansion foam is heavier than foam with higher expansion ratios, and generally has a greater ability to travel through the air over longer distances for a given discharge velocity.

Nozzles designed for use with protein based foam concentrates are of the air-aspirating type. Exemplary nozzles 30 and 32 are shown in FIGS. 3A and 3B, respectively. These nozzles have expansion ratios greater than 6 to 1. Protein based foam concentrates require more energy than do synthetic based concentrates for aeration of the foam solution into expanded firefighting foam. Protein based foams depend on a thick blanket of bubbles, not an aqueous film, for extinguishment.

These nozzles may also be subdivided into two additional types: (1) those in which foam solution is pumped to the nozzle through fire hose or piping as shown in FIG. 3A; and (2) those where water is pumped to the nozzle through fire hose or piping and foam concentrate is supplied to the nozzle through a separate conduit as shown in FIG. 3B.

Nozzles with the ability to pick up concentrate through a separate conduit by use of a built-in-venturi as shown in FIG. 3B have been in widespread use since they were developed in the 1940's. These "self educting" nozzles offer good mixing of the water and foam concentrate, however, the kinetic energy required to assure good mixing and air aspiration reduces the velocity of the discharge stream, thereby shortening the discharge range that can be achieved. On the other hand, nozzles of the variable-pattern fog type with a built-in venturi as shown in FIGS. 2A and 2B, do not offer mixing as good as the air-aspirating type, but because they use less kinetic energy for mixing and air-aspiration their discharge range is enhanced.

Existing nozzles with a built-in means of foam concentrate pick-up as shown in FIGS. 2A, 2B and 3B are all designed so that concentrate enters through a conduit in the side of the nozzle. This conduit then typically connects with a conduit along the central axis of the nozzle bore and inside the main waterway. The conduit may be equipped with a venturi suction chamber, or the end of the conduit may be sealed. If the concentrate conduit is sealed on the inlet end of the nozzle, concentrate must be pumped to the nozzle by a separate pump which could be of the water powered venturi type. Although designs may differ, the basic principle has remained unchanged since its inception.

SUMMARY OF THE INVENTION

It is therefore an object of the present invention to provide a single firefighting nozzle design addressing all four of these problem areas. The invention discharges a solution consisting of fresh, brackish, or sea water, mixed with small amounts of firefighting foam concentrate. This solution is then aerated to form expanded firefighting foam suitable for use by those skilled in the flammable liquid firefighting art. The characteristics of the fire or hazard determine the type and percent concentration of the foam concentrate used, the desired foam expansion ratio, and the type discharge device selected.

Accordingly, the present invention provides a nozzle assembly including a nozzle body having an inlet at a first end and an outlet at a second end. A first fluid passageway is defined within the nozzle body for first fluids passing between the inlet and outlet. Second and third fluid passageways for respective second and third fluids are also defined within said nozzle body. A discharge mixing unit is provided at the second end and is in fluid communication with the first, second and third fluid passageways for mixing the first, second and third fluids to produce a discharge solution. The discharge mixing unit includes one or more mixing chambers provided on the interior surface of the second end of the nozzle body. The mixing chambers are defined between a plurality of inwardly extending blades from the interior surface of the second end. The second end of the nozzle body has an adjustably extending pattern selection sleeve. The third passageway includes a variable fluid flow control device which is operable for varying the expansion ratios of the discharge solution.

DETAILED DESCRIPTION OF THE ILLUSTRATED EMBODIMENTS

Figure 1A:
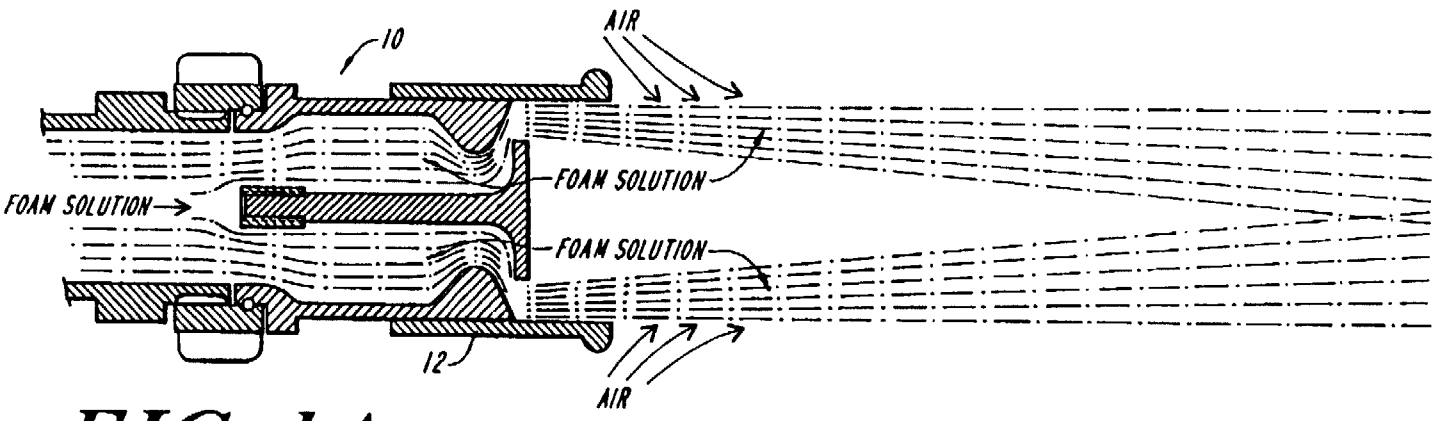
FIG. 1A PRIOR ART
FIGS. 1A and 1B show cross sections of a conventional nozzle with a pattern selection sleeve adjusted outwardly for straight stream discharge and inwardly for fog stream discharge, respectively.
Figure 1B:
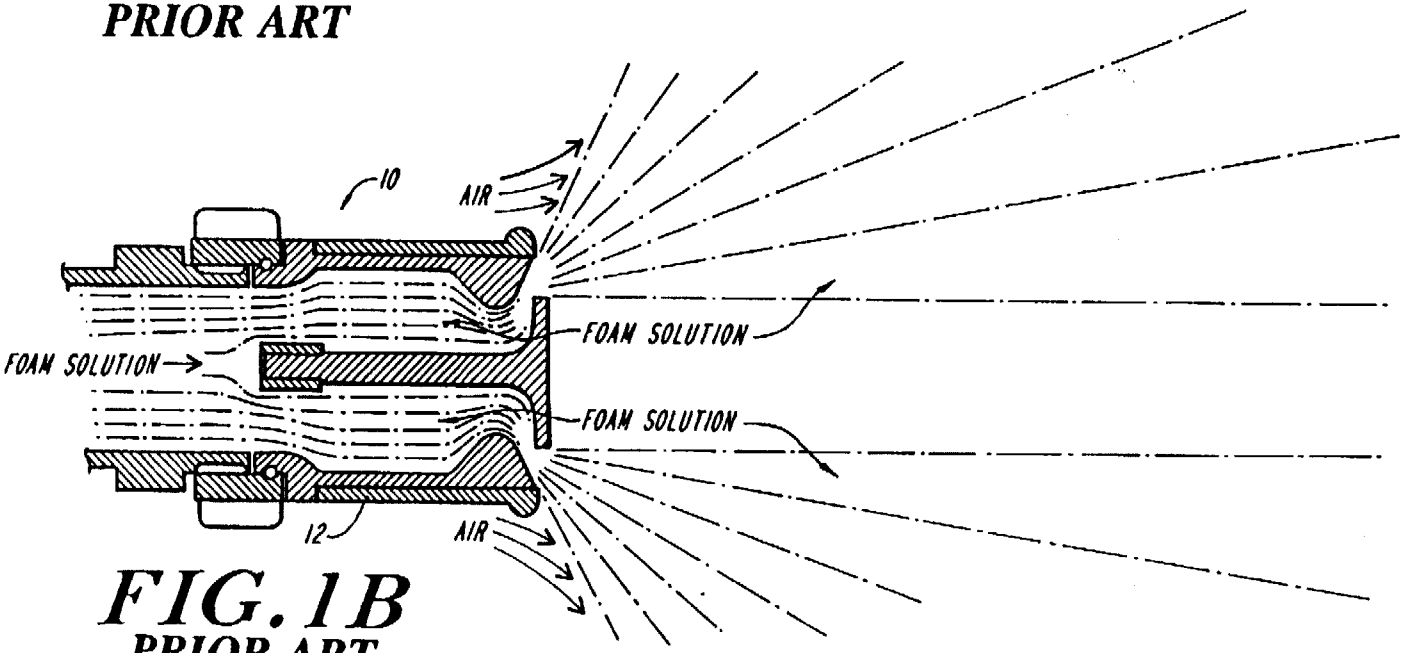
FIG. 1B PRIOR ART
Figure 2A:
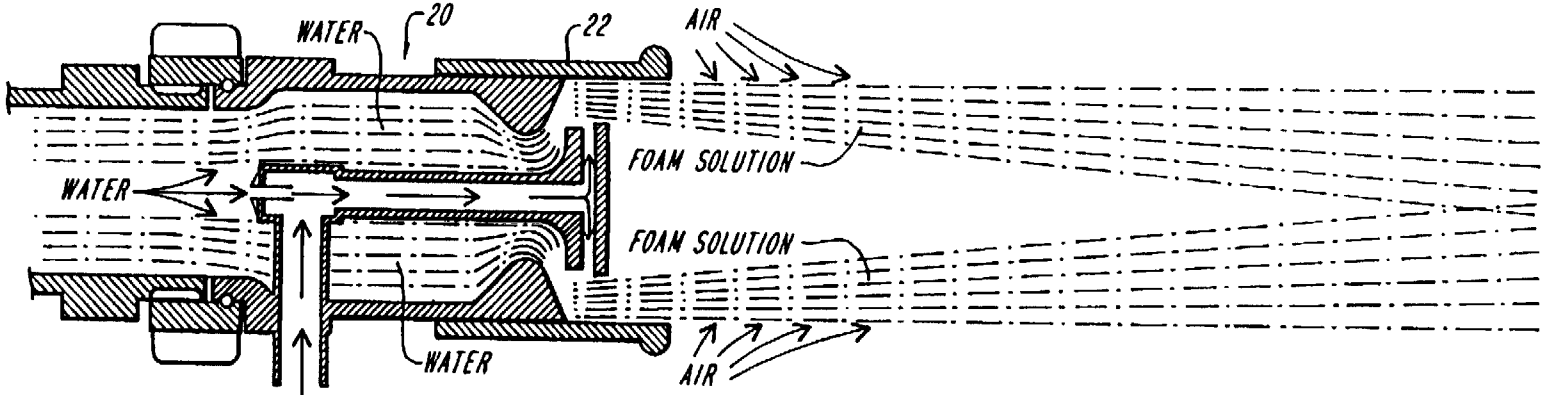
FIG. 2A PRIOR ART
FIGS. 2A and 2B show cross sections of a conventional nozzle using a separate foam concentrate conduit with a pattern selection sleeve adjusted outwardly for straight stream discharge and inwardly for fog stream discharge, respectively.
Figure 2B:
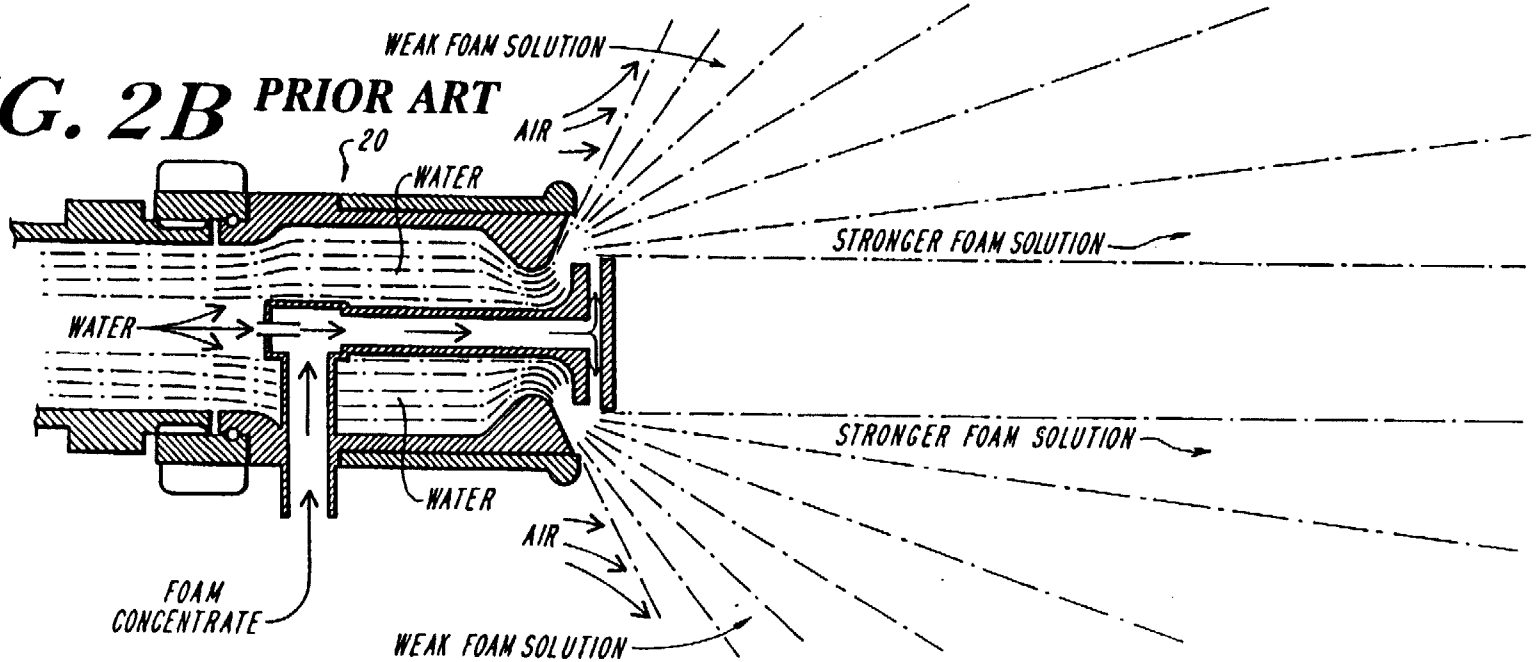
FIG. 2B PRIOR ART
Figure 3A:
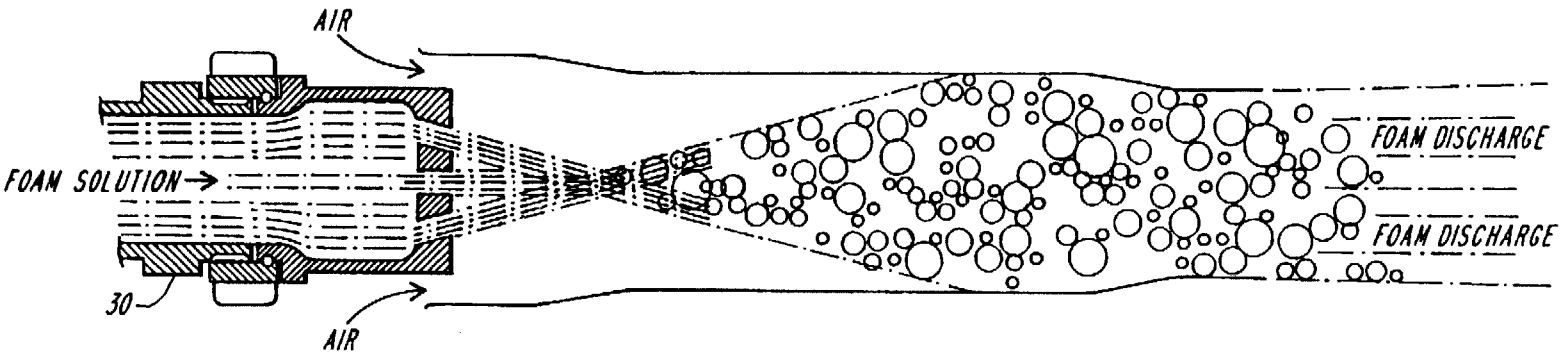
FIG. 3A PRIOR ART
FIG. 3A shows a cross section of a conventional aspirating nozzle in which a foam solution is supplied to the nozzle.
Figure 3B:
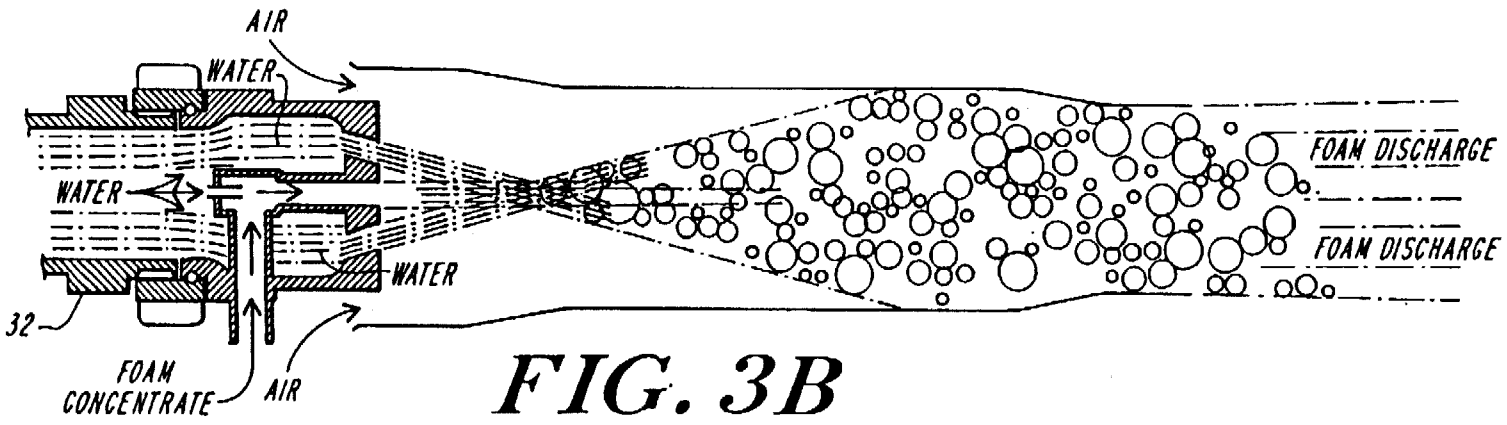
FIG. 3B PRIOR ART
FIG. 3B shows a cross section of a conventional aspirating nozzle in which water and foam concentrate are supplied to the nozzle via different conduits.
Figure 4:
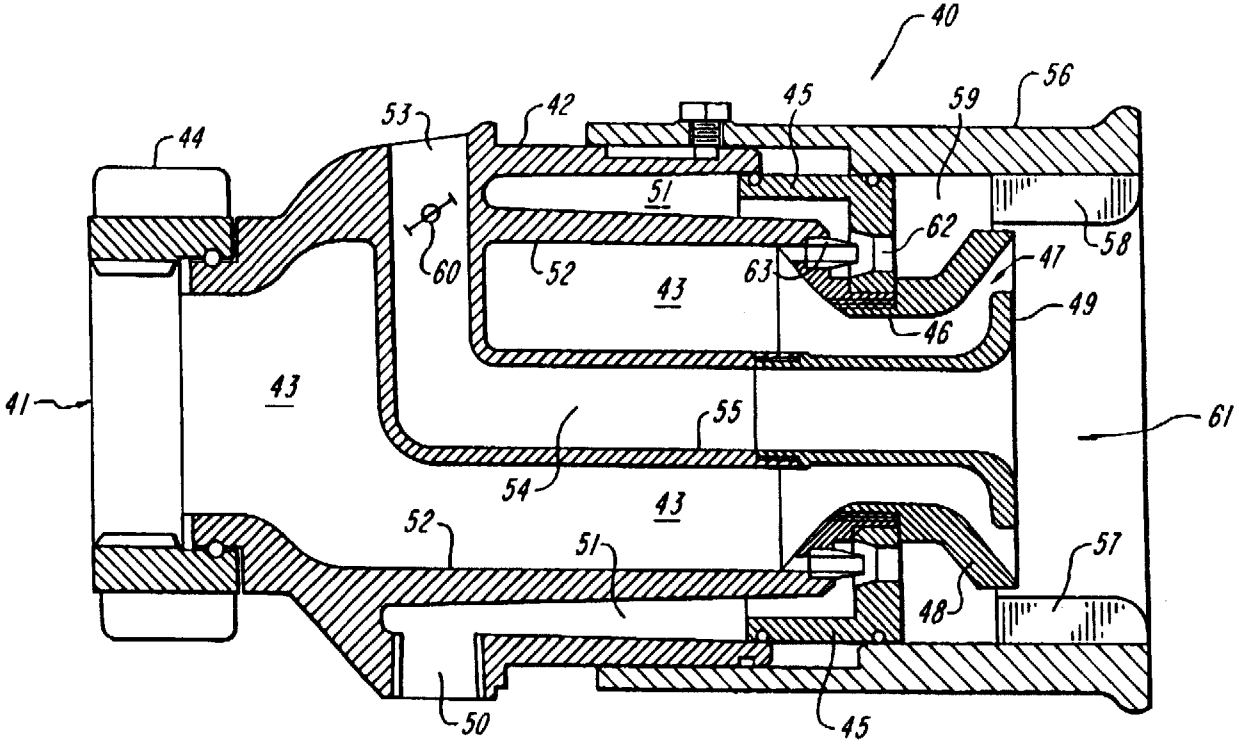
FIG. 4 shows a cross section of a nozzle in accordance with the present invention having a pattern selection sleeve adjusted outwardly for straight stream discharge.
Figure 5:
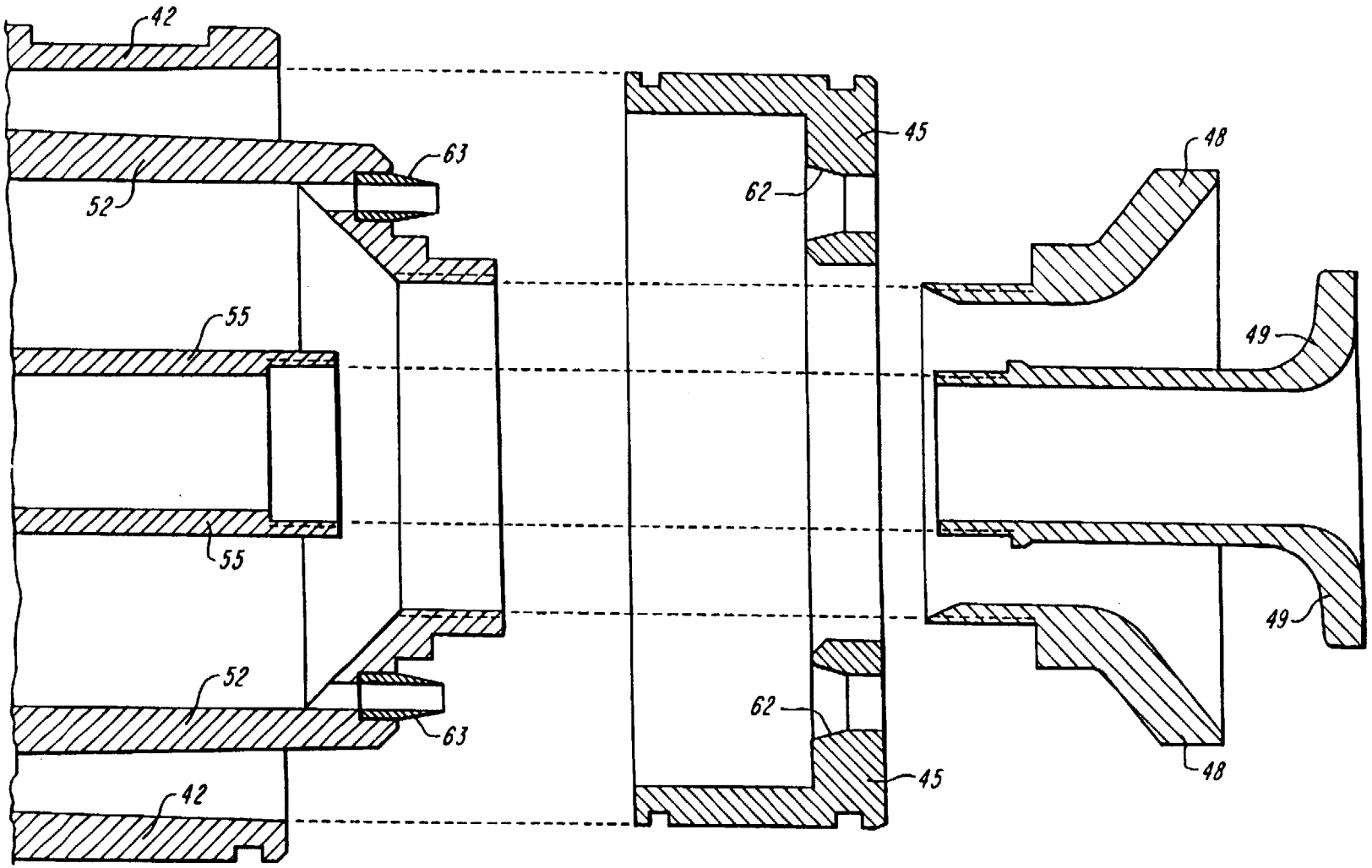
FIG. 5 shows a cross section of the nozzle of FIG. 4 in a disassembled state.
Figure 6:
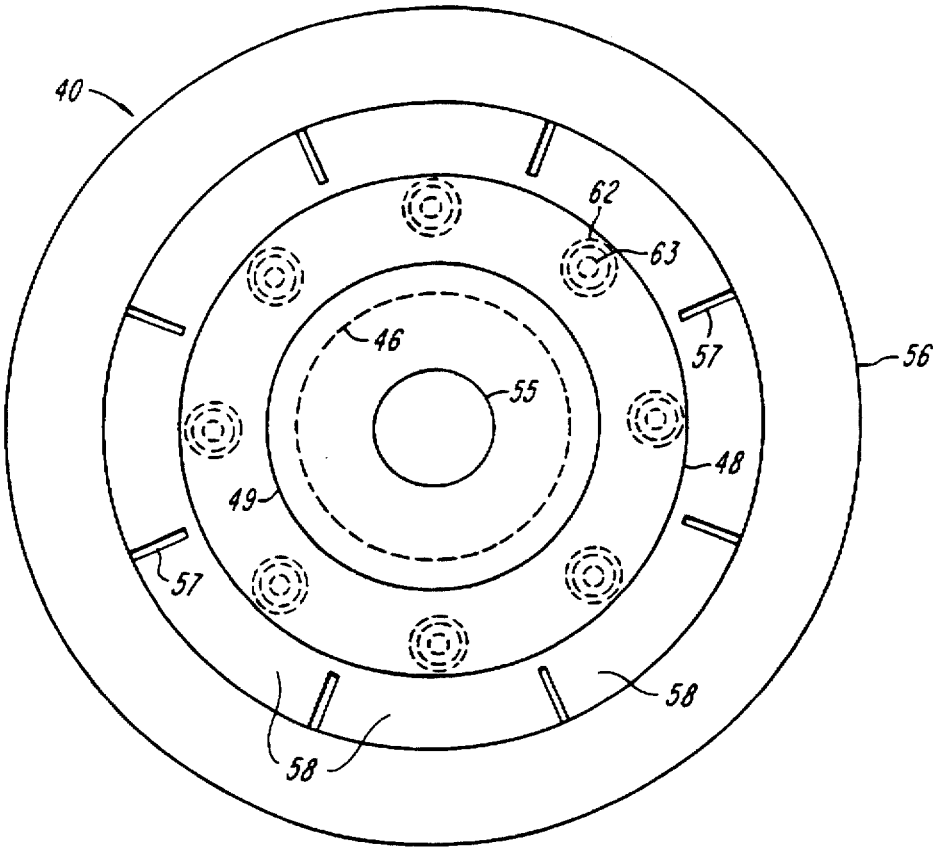
FIG. 6 shows a frontal view of the nozzle of FIG. 4 taken along line 4—4.

An exemplary nozzle assembly 40 in accordance with the present invention is shown in FIGS. 4–6. The nozzle assembly 40 includes a tubular nozzle body 42 having a feed-in conduit 41 leading to an open outlet end and an internal main waterway 43 leading to an open outlet end. A swivel inlet coupler 44 accommodates the attachment of the nozzle to a desired source, e.g. hose, of water or foam.

In accordance with an exemplary embodiment of the present invention, water is pumped through the conduit 41 to the base of the nozzle where it flows into the main waterway 43 via the inlet end. The main waterway has therein a discharge tube assembly 45 which changes having a central short cylindrical tube opening 46 of reduced diameter that curves outward to an annular orifice 47 formed by a nozzle discharge head 48 and a tubular outwardly flared baffle 49. The discharge tube assembly 45 is held in place by the discharge head 48 when the discharge head is screwed into the nozzle body.

The discharge tube assembly 45 includes a plurality of discharge openings 62. Fluid from the main waterway 43 is fed to the openings 62 via a plurality of jet nozzles 63. The interaction between the jet nozzles and openings serving as a jet pump will be described in more detail hereinafter.

A first conduit 50 in the nozzle body communicates with an annular chamber 51, which is concentrically defined around the outside of the main waterway 43. A coaxially displaced cylindrical wall 52 is positioned within the nozzle body in order to separate the main waterway 43 and chamber 51. In accordance with an exemplary embodiment of the present invention, the conduit 50 serves as an entryway for foam concentrate to the annular chamfer 51.

A second tubular conduit 53 in the nozzle body communicates with a chamber 54, which is concentrically defined within the main waterway 43. A coaxially displaced tube 55 is positioned within the nozzle body in order to separate the main waterway and 43 and chamber 54. The tube 55 extends through the main waterway and through the discharge head 48 where it terminates as the outwardly flared baffle 49. In accordance with an exemplary embodiment of the present invention, the conduit 53 serves as a means for entraining air into the nozzle.

The nozzle body also includes an adjustable pattern selection sleeve 56 which extends axially from the nozzle body 42 at a location surrounding its outlet end. The pattern selection sleeve is adjustable between a fully extended outward position as shown which promotes straight stream discharge of fluids from the nozzle, and an inward position which promotes fog stream discharge of fluids from the nozzle.

In accordance with the present invention, a plurality of vanes 57 extend radially inwardly from the inner circumferential end surface of the pattern selection sleeve 56. The plurality of vanes 57 in turn define a plurality of mixing chambers 58 therebetween. The mixing chambers are in fluid communication with both the main waterway 43 and the chamber 51 associated with the first conduit 50 via a chamber 59. The chamber 59 is defined between the inner surface of the pattern selection sleeve 56 and the discharge head 48.

The nozzle configuration shown in FIG. 4 gradually increases the velocity head of the water stream, thereby decreasing the pressure head. In the situation where a water stream from the main waterway 43 passes through the annular orifice 47 and is discharged to atmosphere, all of the available kinetic energy has been converted to velocity head. Water passes over the outer edge of the discharge head 48 and enters the multiple mixing chambers 58 formed by the vanes 57 on the pattern selection sleeve. Within the mixing chambers 58, the water mixes with foam concentrate flowing from conduit 50 and chamber 51 via chamber 59.

Figure 7:
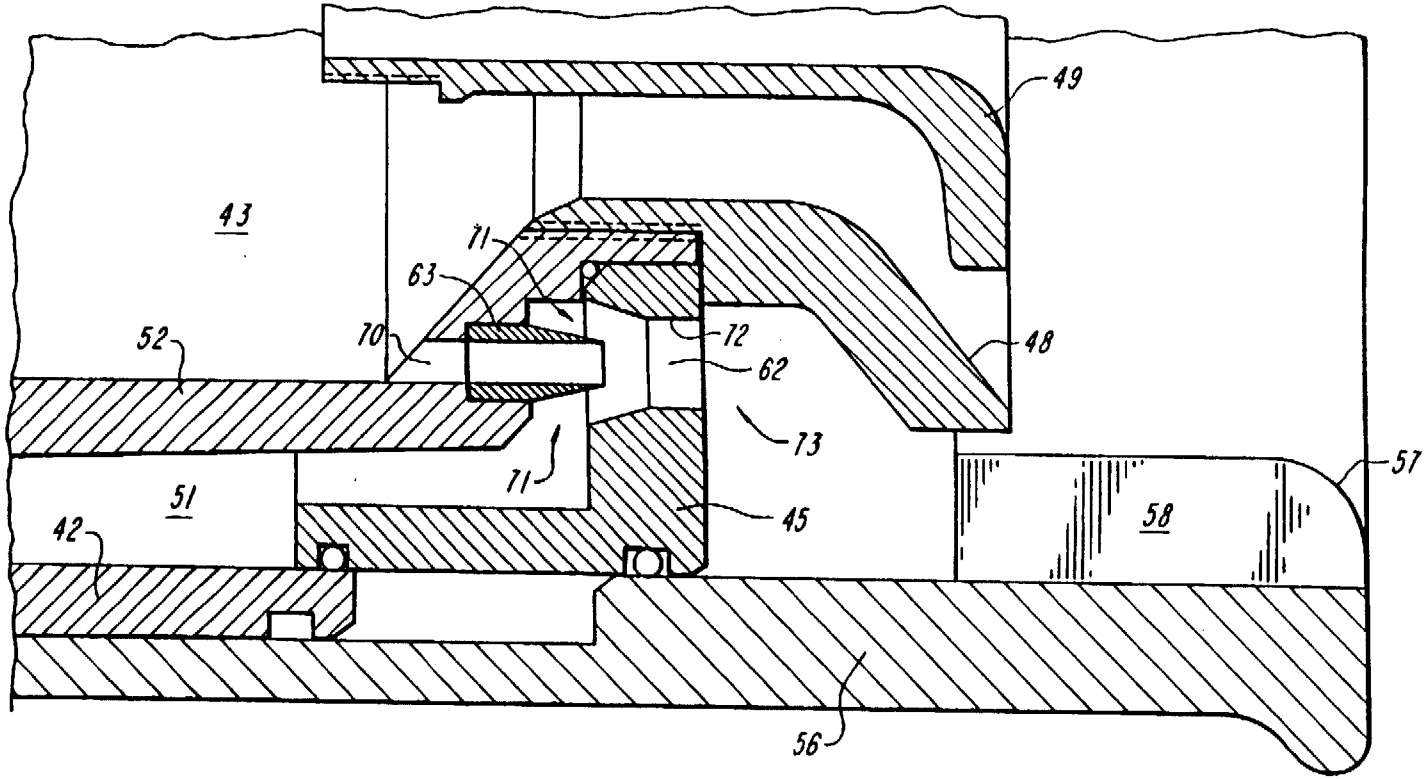
FIG. 7 shows an exploded cross section view of the jet nozzles and discharge tube assembly openings from the nozzle of FIG. 4.

With reference now to FIG. 7, a more detailed description of the jet pump action of the openings 62 and jet nozzles 63 is provided. Each jet nozzle 63 includes an inlet 70 for fluid communication with the main waterway 43. A suction chamber 71 is defined at the outlet of the nozzle jet and the opening 62, which in turn are in fluid communication with the chamber 51. The opening 62 includes a cylindrical parallel section 72 which feeds to a diffuser/discharge area 73 in chamber 59.

The ability of the jet pump formed by jet nozzle 63 and opening 62 to educt a fluid is based on the same principle found in all nozzles of the self educting type. This same principle is used in air aspirating nozzles to pick up air and aspirate the foam solution. The inlet 70 is the area where fluid enters the jet pump nozzle. The suction chamber 71 is an area where fluid being pumped enters the jet pump, and where high velocity fluid from the jet pump nozzle entrains fluid being pumped from suction. The parallel section 72 is an area where fluid being pumped mixes with fluid from the jet pump nozzle, thereby acquiring energy from the nozzle discharge. The diffuser/discharge area is an area where fluids loose velocity and regain static pressure due to velocity change so that fluids can enter pressurized area in the mixing chambers 58 formed by the blades 57.

According to a preferred embodiment, it is critical that the included angle of the discharge head 49 is 90° or less. If this included angle is greater, pressure rises excessively in chamber 59 so that the jet pumps are no longer capable of operating. The jet pumps will operate up to a back pressure equal to 10% of the nozzle operating pressure, and if the included angle is greater than 90°, the back pressure in chamber 59 will exceed this 10% limit.

With reference back to FIGS. 4–6, a variable air flow control device 60, e.g. a conventional air flow valve, may be opened to allow air to flow through the conduit 53 and chamber 54 along the nozzle axis. Air exits the central chamber 54 into a low pressure area 61 which exists behind the outwardly flared baffle 49 at the end of the tube 55. The low pressure area 61 is created by water flow out of the annular office 47 being deflected by the pattern selection sleeve 56 to flow parallel, or nearly so, to the axis of the nozzle. Air enters mixing chambers 58 and mixes with the foam solution to form finished foam for discharge.

The variable air flow control device 60 may be closed completely to provide lower expansion ratios when AFFF foams are used for spill fires. Alternatively, the air flow control device may be fully opened to provide higher expansion ratios when protein based foams are used.

In situations where foam solution is pumped to the nozzle feed-in conduit 41 through the main waterway 43, it is not necessary to use the conduit 50 and chamber 51 for admitting foam concentrate to the nozzle. Instead, the conduit 50 and chamber 51 can be used for additional aeration. In this manner, air is allowed to enter the chamber 51, where it can flow through the chamber 59 into the mixing chambers 58, thus allowing greater aeration and higher expansion ratios for the discharged foam solution.

Accordingly, the present invention provides a firefighting nozzle for use in flammable liquid firefighting and has a unique combination of benefits not available in conventional nozzle designs. The invention combines several desirable characteristics in a cost effective design. For example, when adjusted at or near the straight stream patterns, aeration takes place on the outside of the stream as in existing nozzles, but the unique central air passage allows the option of selecting higher expansion ratios by allowing air to enter the low pressure area created inside the discharge pattern.

The use of the blades 57 located on the inside of the outer pattern selection sleeve 56 serve multiple functions. The blades act as straightening vanes to cancel the twisting currents developed inside the nozzle and the negative effect these currents have on the discharge pattern, thus tending to increase the discharge range capability with aerated foams. The blades 57 separate the discharge area into the plurality of mixing chambers 58 to enhance mixing of the water and foam concentrate when the liquids must mix in the nozzle. The separate mixing chambers formed by the blades allow greater agitation and aeration of the solution when the central airway is opened and the nozzle is adjusted at, or near the straight stream pattern. If foam solution is pumped to the nozzle and the concentrate chamber around the main conduit is left open to atmosphere, more air enters the mixing chambers formed by the blades and additional aeration occurs.

Furthermore, when water and foam concentrate are supplied through separate conduits, good mixing will occur in the mixing chambers, regardless of the pattern selected.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. A nozzle assembly for combining a liquid foam concentrate with a liquid to produce a fire extinguishing foam solution, said nozzle assembly comprising:

a tubular body having axially aligned inlet and outlet openings;

wall means for internally subdividing said body into an axial passageway surrounded by an annular chamber, opposite ends of said passageway being in communication with said inlet and outlet openings to accommodate a flow of said liquid through said body;

a sleeve surrounding said outlet opening and extending axially from said body;

means for introducing a supply of said foam concentrate into said annular chamber;

a plurality of openings in said wall means spaced around said passageway;

jet nozzles for diverting a portion of the liquid flowing through said passageway into said openings to mix with and educt foam concentrate from said annular chamber for delivery into the interior of said sleeve; and guide means for directing an annular exiting flow of said liquid from said outlet opening outwardly towards the interior of the surrounding sleeve to additionally mix said liquid with the educted foam concentrate and to thereby produce a dilute mixture of foam solution within said sleeve.

2. The nozzle assembly as claimed in claim 1 further comprising means for axially adjusting said sleeve between extended and retracted positions relative to said body.

3. The nozzle assembly as claimed in claims 1 or 2 further comprising circumferentially spaced vane members extending radially inwardly from said sleeve to define mixing chambers therebetween, said mixing chambers receiving and mixing the educted foam concentrate with the outwardly directed annular exiting liquid flow from said guide means, said vane members being configured and dimensioned to direct the liquid mixture from said mixing chambers toward the outlet opening of said sleeve.

4. The nozzle assembly as claimed in claim 3 wherein the configuration and arrangement of said vane members is such that when said sleeve is in its extended position, the liquid mixture exiting from said mixing chambers is further directed to flow toward the outlet opening of said sleeve in a direction parallel to the axial centerline of said nozzle.

5. The nozzle assembly, as claimed in claim 1 further comprising a tubular conduit extending axially through said passageway, said conduit having an entry end open to atmosphere and a discharge end protruding centrally into an area circumscribed by the annular exiting flow of liquid from said outlet opening, said circumscribed area being in communication with said tubular conduit to thereby aerate said liquid mixture within said mixing chambers prior to discharge from said sleeve.

6. The nozzle assembly as claimed in claim 5 further comprising valve means in said tubular conduit for controlling the flow of entrained air therethrough.

* * * * *